US005370560A

United States Patent [19]

Ito

[11] Patent Number: 5,370,560

[45] Date of Patent: Dec. 6, 1994

[54] TERMINAL FOR FIXING WIRES

[75] Inventor: Akira Ito, Yokkaichi, Japan

[73] Assignee: Sumitomo Wiring Systems, Ltd., Yokkaichi, Japan

[21] Appl. No.: 155,324

[22] Filed: Nov. 22, 1993

Related U.S. Application Data

[62] Division of Ser. No. 979,223, Nov. 20, 1992, Pat. No. 5,316,506.

[30] Foreign Application Priority Data

Nov. 26, 1991 [JP] Japan ..... 3-310770

[51] Int. Cl.[5] ..... H01R 4/18

[52] U.S. Cl. ..... 439/877; 174/94 R; 439/879

[58] Field of Search ..... 439/877–882; 174/84 C, 74 R, 94 R

[56] References Cited

U.S. PATENT DOCUMENTS

| | | | |
|---|---|---|---|
| 2,724,098 | 11/1955 | Bergan | 439/879 |
| 3,053,930 | 9/1962 | Mallanik et al. | 439/877 |
| 3,129,995 | 4/1964 | Brown | 439/417 |
| 3,156,764 | 11/1964 | Toedtman | 174/94 R |
| 3,387,080 | 6/1968 | Dibble et al. | 174/94 R |
| 3,522,365 | 7/1970 | Dannes | 174/94 R |
| 3,715,705 | 2/1973 | Kuo | 439/422 |
| 3,777,302 | 12/1973 | Travis | 439/854 |
| 3,989,339 | 11/1976 | Haitmanek | 439/421 |
| 4,442,316 | 4/1984 | Thuermer | 174/84 C |

FOREIGN PATENT DOCUMENTS

| | | |
|---|---|---|
| 2214178 | 8/1974 | France . |
| 1808282 | 9/1970 | Germany . |
| 3411265 | 6/1953 | Japan . |
| 704091 | 2/1954 | United Kingdom . |

*Primary Examiner*—Gary F. Paumen

*Attorney, Agent, or Firm*—Sughrue, Mion, Zinn, Macpeak & Seas

[57] ABSTRACT

Two or more core wires are inserted into an approximately U-shaped barrel of a terminal and fixed to the terminal and each other. The terminal comprises a tab having serrations, formed on the upper and lower surfaces thereof, disposed along the boundary between the core wires so that the serrations shear an oxide film formed on the core wires in contact with the upper and lower surfaces of the tab and remove the oxide film from the core wires, whereby the core wires are electrically connected with each other via the tab. The tab is integral with or separate from a connector terminal or an inter-connecting terminal.

2 Claims, 7 Drawing Sheets

TERMINAL FOR FIXING WIRES

This is a divisional of application Ser. No. 07/979,223 filed Nov. 20, 1992, now U.S. Pat. No. 5,316,506 issued May 31, 1994.

BACKGROUND OF THE INVENTION

1. Field of the Invention

The present invention relates to a connector terminal and an inter-connecting terminal and more particularly to a terminal provided with a core wire-fixing barrel in which two or more electric wires are inserted and crimped on the wires to contact with the wires and fix them, and for reducing the contact resistance between electric wires in fixing two or more electric wires thereto by a barrel and between the wires and the terminal.

2. Description of the Related Art

A connector terminal to be used to connect electric wires of a wire harness of an automobile or electric office automation equipment has a construction as shown in FIG. 10. An inter-connector terminal or an intermediate joint terminal for connecting electric wires without the intermediary of a connector has a construction as shown in FIG. 13.

That is, the connector terminal 1 which is solid comprises an electrical contact portion 3 disposed in the front of a bottom 2 and a core wire-fixing barrel 4 and a coating film-fixing barrel 5 both disposed in the rear of the bottom 2. The inter-connecting terminal 6, which is U-shaped in its sectional configuration, consists of only a core wire-fixing barrel 7.

A W-type fixing method, a C-type fixing method or an F-type fixing method, soldering or welding is used to connect the electric wires to the connector terminal 1 or the interconnecting terminal 6. The F-type fixing method is most widely used because this method is the most efficient of these methods.

As shown in FIGS. 15 and 16, according to F-type fixing method, in fixing two electric wires W1 and W2 to the inter-connecting terminal 6, the inter-connecting terminal 6 is placed on an anvil 11 of a presser 10. The core wire 8 of the electric wire W1 and the core wire 8' of electric wire W2 are inserted into the core wire-fixing barrel 4 with the core wire 8 held in a higher space and the core wire 8' held in a lower space. Then, a crimper 12 is moved downwardly to deform the barrel 7 and fix the core wires 8 and 8' to the interconnecting terminal 6. In fixing the electric wires W1 and W2 to the connector terminal 1, the core wire 8 of the electric wire W1 and the core wire 8' of the electric wire W2 are inserted into the core wire-fixing barrel 4 and the coating film 9 of the electric wire W1 and the coating film 9' of the electric wire W2 are inserted into the coating film-fixing barrel 5. Then, the crimper 12 is moved downwardly to deform the barrels 4 and 5 and fix the core wires 8 and 8' to the core wire-fixing barrel 4 and coating films 9 and 9' to the coating film-fixing barrel 5.

As a result, the core wire 8 and the core wire 8' are connected with the connector terminal 1 or the inter-connecting terminal 6, respectively. The conventional connector terminal 1 or the inter-connecting terminal 6 has a problem in that oxide film formed on the surface of the core wires 8 and 8' acts as a contact resistance in connecting the core wires 8 and 8' with the connector terminal 1 or the inter-connecting terminal 6.

In order to solve this problem, as shown in FIGS. 11 and 13, a plurality of serrations 13 is formed on the inner surface of the bottom of the core wire-fixing barrels 4 and 7 and that of the side walls thereof so as to shear and remove the oxide film from the core wires 8 and 8' by means of edges 13*a* of the serrations 13. This construction is disclosed in examined Japanese Utility Model Publication No. 34-11265.

However, as shown in FIGS. 12 and 14, the above-described construction is not effective for removing the oxide film from the core wires in fixing two or more core wires the barrels 4 and 7.

That is, as shown in FIG. 17, the core wire 8' disposed in the lower space of each of the barrels 4 and 7 contacts the serrations 13 formed on the bottom thereof in a large area, but the core wire 8 mainly contacts the serrations 13 formed on upper portions of the side walls of the barrels 4 and 7. Therefore, the core wire 8 contacts the serrations 13 in a small area. In addition, the core wires 8 and 8' disposed along the boundary (X) between the electric wires W1 and W2 do not contact the serrations 13. Accordingly, the oxide film is not removed therefrom along the boundary (X). That is, there is a possibility that the core wires 8 and 8' are not connected electrically.

As apparent from the above description, according to the above-described construction, the electric wires W1 and W2 are not electrically connected with each other because of the above-described reason.

In recent years, the operation of an automobile has been electronically controlled and hence micro-current circuits have been increasingly used and large current circuits generate a great amount of heat due to the use of a large capacity synchronous generator. In this situation, there are strong demands for the drop of the contact resistance between the core wires and the terminal and between the wires.

SUMMARY OF THE INVENTION

It is an object of the present invention to provide a terminal for fixing two or more core wires thereto with the contact resistance between the core wires reduced to electrically connect the core wires therewith by dropping the contact resistance between the core wires and the terminal.

In accomplishing these and other objects of the present invention, there is provided a terminal for inserting two or more core wires into an approximately U-shaped barrel thereof and fixing them thereto comprising: a tab having serrations, formed on the upper and lower surfaces thereof, disposed along the boundary between the core wires so that the serrations shear an oxide film formed on the core wires in contact with the upper and lower surfaces of the tab and remove the oxide film from the core wires, whereby the core wires are electrically connected with each other via the tab.

According to the above-described construction, the tab having the serrations formed thereon is interposed between the core wires of the electric wires. Accordingly, the serrations remove the oxide film formed on the core wires disposed on the boundary between the core wires. As a result, the core wires can be connected with each other via the tab. That is, the core wires in contact with the terminal are connected therewith via the peripheral surface of the core wires, and the core wires not in contact with the terminal are connected therewith via the tab between the core wires. Thus, the electrical connection between the core wires 8 and 8' and the terminal 20 can be reliably accomplished.

The tab may be inserted and disposed on the boundary between the cores inserted in the space of the barrel as a separate member.

In order to form the tab, it is possible to cut or bend a part of the barrel so as to project the part inward horizontally from the inner surfaces of both side walls thereof.

With respect to the inter-connecting terminal, it is possible to bend inwardly a part of the barrel projecting from the front end of the barrel.

The tab may be separate from the terminal or integral therewith. But preferably, the tab is integral with the terminal in view of the operation efficiency. The length of the tab is preferably identical with that of the barrel because the area of contact with the serrations increase so as to improve electrical contact.

The serrations to be formed on the upper and lower surface of the tab at regular intervals may be arranged horizontally or diagonally. The serrations may be circular, rectangular, cross or in any desired configurations so long as the serrations shear and remove the oxide film of the core wires.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
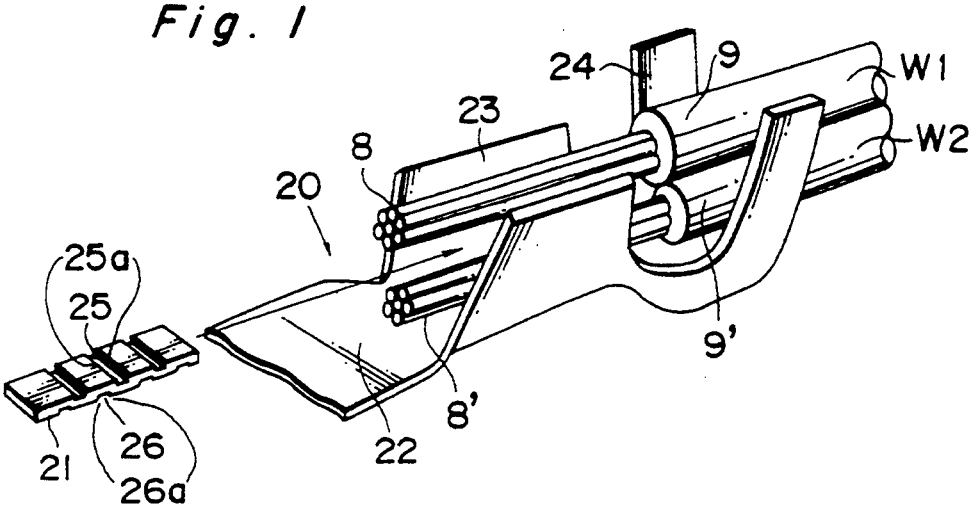
FIG. 1 is a perspective view showing a terminal according to a first embodiment of the present invention.

Before the description of the present invention proceeds, it is to be noted that like parts are designated by like reference numerals throughout the accompanying drawings, in which:

The embodiment of the present invention will be described below with reference to the drawings.

A terminal of a first embodiment of the present invention will be described below with reference to FIGS. 1 through 3. In the first embodiment, a separate tab 21 is inserted into a connector terminal 20.

The construction of the terminal 20 is similar to that of the conventional connector terminal 1. That is, the terminal 20 comprises an electric contact portion (not shown) disposed forwardly of a bottom 22; a core wire-fixing barrel 23, approximately U-shaped in its sectional configuration, disposed in the middle thereof; and an coating film-fixing barrel 24 disposed rearwardly thereof. Serrations **23*a* are formed on the inner surface of the core wire-fixing barrel 23 as shown in FIG. 3**.

The material of the tab 21 is the same as that of the terminal 20, i.e., the tab 21 is made of a rectangular conductive metal. The width of the tab 21 is a little smaller than that of the core wire-fixing barrel 23 and the length thereof is a little shorter than that of the core wire-fixing barrel 23.

The tab 21 has grooves 25 and 26 spaced at certain intervals on the upper and lower surfaces thereof. The grooves 25 and 26 have sharp edges **25*a* and 26*a***, respectively formed on the corners thereof to shear oxide films formed on core wires of electric wires.

The electric wires W1 and W2 are fixed to the terminal 20 as follows: The core wire 8' of the electric wire W2 is inserted into the core wire-fixing barrel 23 and then the tab 21 is placed on the upper side of the core wire 8' and thereafter, the core wire 8 of the electric wire W1 is placed on the upper surface of the tab 21. The core wires 8 and 8' are fixed to the core wire-fixing barrel 23 and the electric wires W1 and W2 are fixed to the coating film-fixing barrel 24 by the method previously described.

Figure 2:
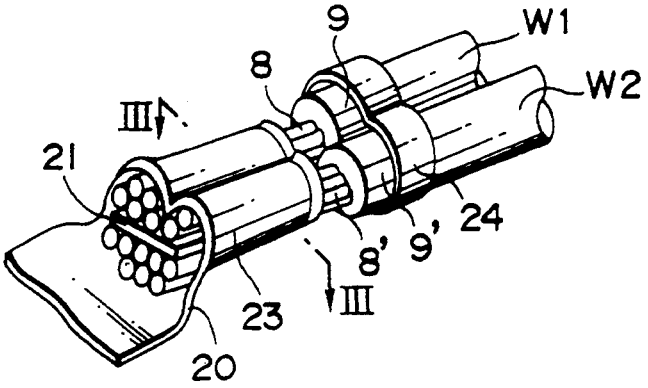
FIG. 2 is a perspective view showing the state in which the electric wires shown in FIG. 1 are fixed to the terminal.
Figure 3:
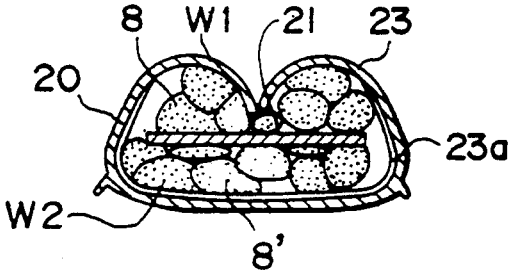
FIG. 3 is a sectional view taken along a line III—III of FIG. 2.

FIGS. 2 and 3 show the state in which the core wires 8 and 8' are fixed to the core wire-fixing barrel 23 surrounding them, with the tab 21 interposed between the core wires 8 and 8'.

The oxide films of the core wires 8 and 8' in contact with the serrations **23*a* of the wire-fixing barrel 23 are sheared thereby and removed from the core wires 8 and 8' As a result, the terminal 20 and the electric wires W1 and W2 are electrically connected with each other via the oxide film-removed portions of the core wires 8 and 8'. Similarly, the oxide film of the core wires 8 and 8' in contact with the serrations 25 and 26 of the tab 21 are sheared thereby and removed from the wires 8 and 8'. As a result, the terminal 20 and the core wires 8 and 8' are electrically connected with each other via the tab 21. That is, the lower portion of the core wires 8' and the upper portion of the core wires 8 are directly contacted with the terminal 20 and are electrically connected with the terminal, while the upper portion of the core wires 8' and the lower portion of the core wires 8 are contact with the tab 21** and are connected with the terminal 20 by the connection between the core wires 8' and 8 through the tab 21. Thus, the electrical connection between the core wires 8 and 8' and the terminal 20 can be reliably accomplished.

Figure 4:
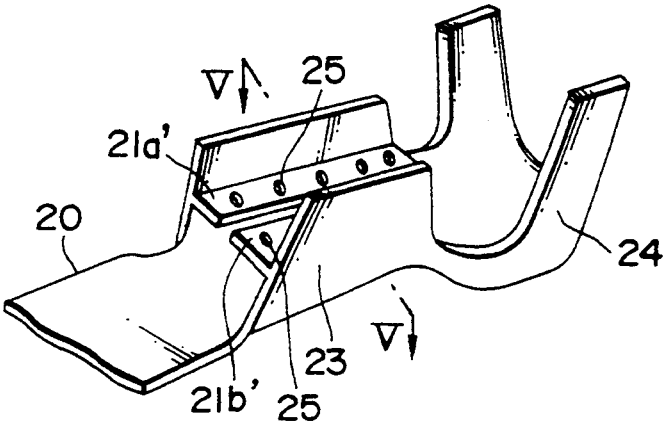
FIG. 4 is a perspective view showing a terminal according to a second embodiment of the present invention.
Figure 5:
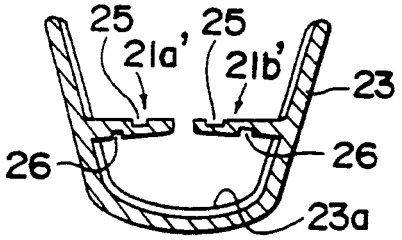
FIG. 5 is a sectional view taken along a line V—V of FIG. 4.

A connector terminal 20 according to a second embodiment will be described below with reference to FIGS. 4 and 5. In the second embodiment, the tab 21 is integral with the terminal 20. That is, a pair of tabs 21*a*' and 21*b*' projects horizontally inward from the inner surfaces of both side walls of the core wire-fixing barrel 23 so that the tabs 21*a*' and 21*b*' are positioned in the middle of the core wire-fixing barrel 23 in the vertical direction thereof. The interval between the tabs 21*a*' and 21*b*' is slight, thus partitioning the space surrounded with the bottom of the core wire-fixing barrel 23 and the side walls thereof into an upper space and a lower space. The tabs 21*a*' and 21*b*' have serrations 25 and 26 formed on the upper and lower surfaces thereof similarly to the first embodiment.

Two electric wires are inserted into the tabs 21*a*' and 21*b*' as follows: One core wire is inserted into the lower space and the other core wire is inserted into the upper space. Thus, the electric wires can be reliably and easily inserted into the core wire-fixing barrel 23.

The operation in fixing the electric wires to the terminal 20 and the connection state thereof are similar to those of the first embodiment. Therefore, the descriptions thereof are omitted herein.

Figure 6A:
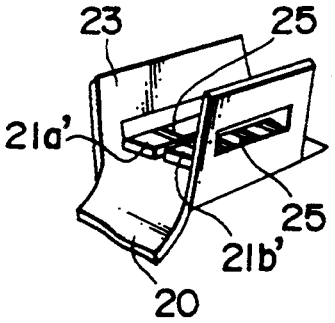
FIGS. 6A and 6B are perspective views showing modifications of the second embodiment of the present invention, respectively.

Modifications of the second embodiment are described below with reference to FIGS. 6A and 6B. As shown in FIG. 6A, a pair of the tabs 21*a*' and 21*b*' is formed by partly cutting a middle portion of the core wire-fixing barrel 23 and projecting the cut portion horizontally inward from both side walls of the core wire-fixing barrel 23.

Figure 6B:
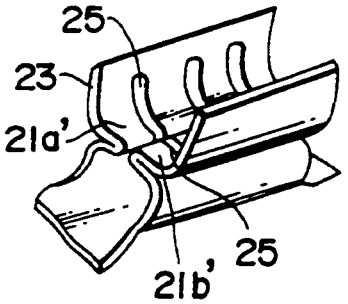

As shown in FIG. 6B, a pair of the tabs 21*a*' and 21*b*' is formed by bending a middle portion of the core wire-fixing barrel 23 so as to project horizontally inward from both side walls thereof.

Figure 7:
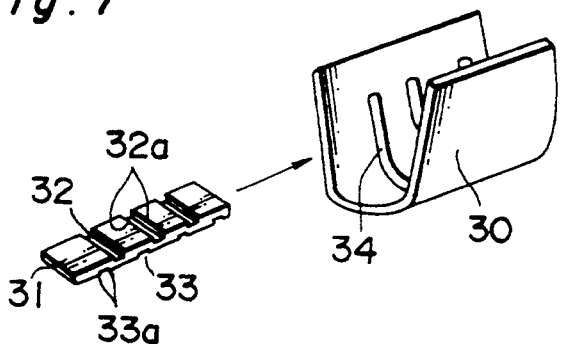
FIG. 7 is an exploded showing a terminal according to a third embodiment of the present invention.

An inter-connecting terminal 30 according to a third embodiment will be described below with reference to FIG. 7. In the third embodiment, a separate tab 31 is inserted into the inter-connecting terminal 30. The third embodiment corresponds to the first embodiment in which the separate tab 21 is inserted into the connector terminal 20. That is, serrations 32 and 33 formed on the upper and lower surfaces of the plate-shaped tab 31 shear the oxide film of core wires in contact with the upper and lower surface of the tab 31 by means of edges 32*a* and 33*a* of the serrations 32 and 33, respectively. In addition, the serration 34 formed on the inner surface of the terminal 30 shears the oxide film of the core wires in contact therewith.

The operation of fixing the core wires to the terminal 30 and the effect obtained by the operation are similar to those of the first embodiment. Therefore, the descriptions thereof are omitted herein.

An inter-connecting terminal according to a fourth embodiment will be described below with reference to FIGS. 8A, 8B, and 8C. In the fourth embodiment, the tab is integral with the inter-connecting terminal 30.

Figure 8A:
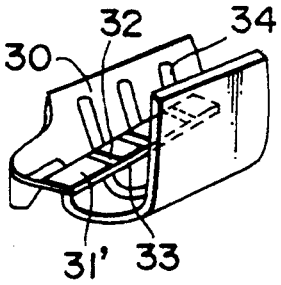
FIGS. 8A, 8B, and 8C are perspective views showing a terminal according to a fourth embodiment of the present invention, respectively.

As shown in FIG. 8A, the tab 31' is formed on one side wall of the terminal 30. More specifically, the tab 31' is formed by bending inwardly a part of the barrel projecting from the front of the lower portion of one side wall so that the tab 31' is positioned in the center of the terminal 30 in the vertical direction thereof.

Figure 8B:
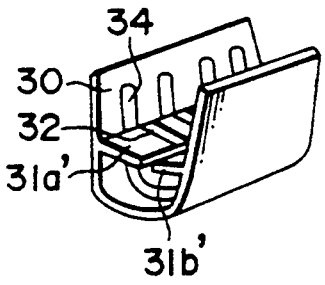

As shown in FIG. 8B, a pair of tabs 31*a*' and 31*b*' projects inwardly from the inner surface of both side walls of the barrel. The inter-connecting terminal according to this example corresponds to the second embodiment.

Figure 8C:
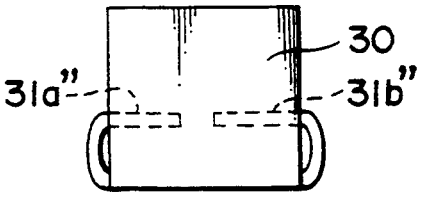

As shown in FIG. 8C, a tab 31*a*" is formed by bending inwardly a part of the barrel projecting from the front of the lower portion of one side wall, and a tab 31*b*" is formed by bending inwardly a part of the barrel projecting from the rear of the lower portion of the other side wall.

Figure 9A:
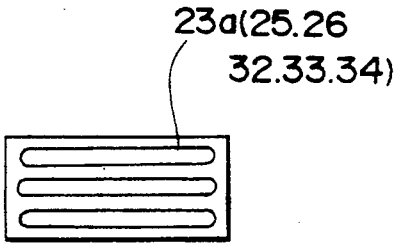
FIG. 9A through 9F are views showing an example of a serration, respectively.
Figure 9B:
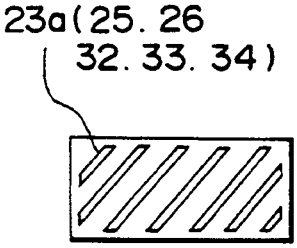
Figure 9C:
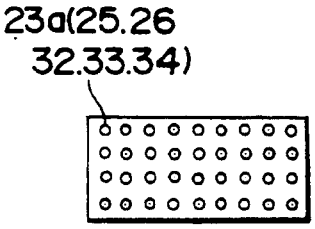
Figure 9D:
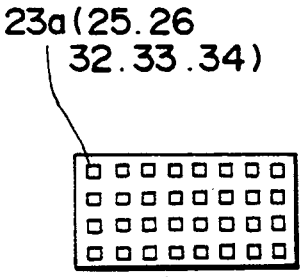
Figure 9E:
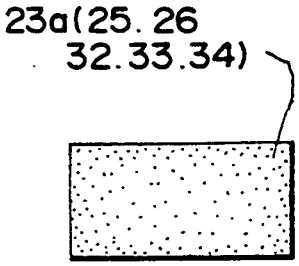
Figure 9F:
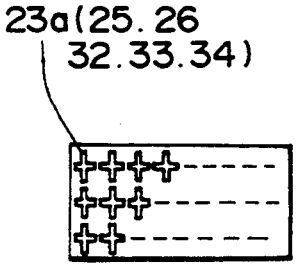
Figure 10:
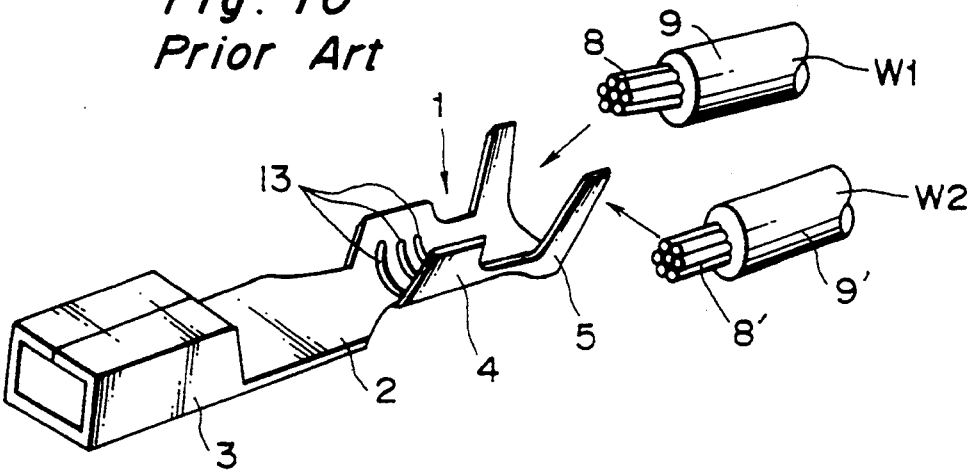
Fig. 10 Prior Art
FIG. 10 is an exploded view showing a conventional connector terminal and electric wires.
Figure 11:
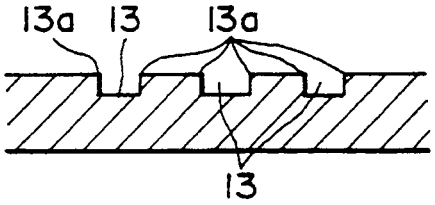
Fig. 11 Prior Art
FIG. 11 is a sectional view showing a serration of FIG. 10.
Figure 12:
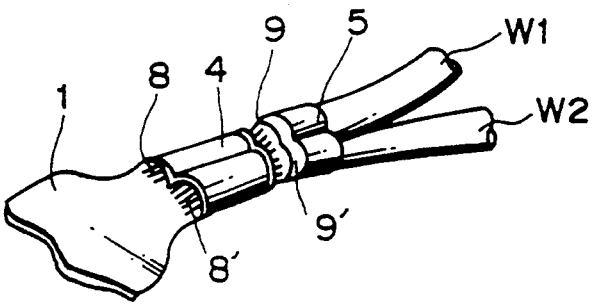
Fig. 12 Prior Art
FIG. 12 is a perspective view showing the state in which the electric wires are fixed to the connector terminal of FIG. 10.
Figure 13:
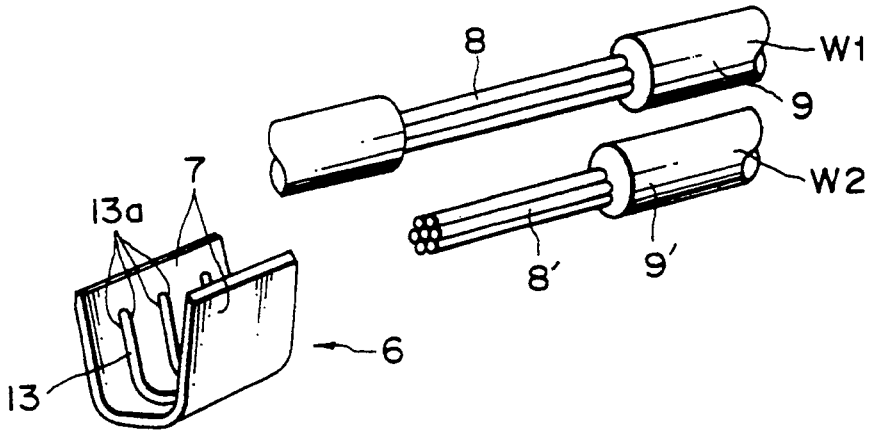
Fig. 13 Prior Art
FIG. 13 is an exploded view showing a conventional inter-connecting terminal and electric wires.
Figure 14:
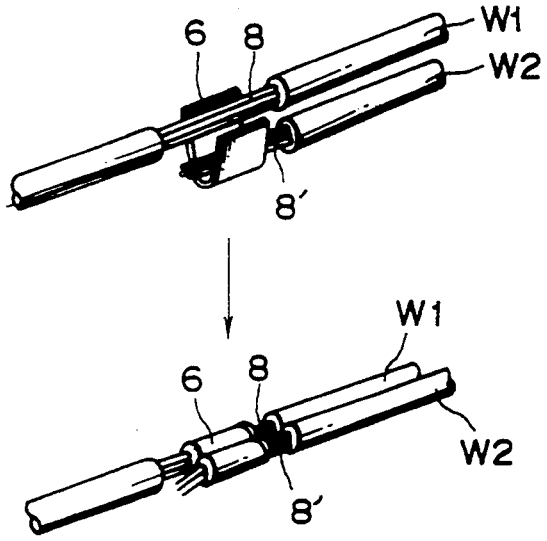
Fig. 14 Prior Art
FIG. 14 is a perspective view showing the process of fixing the electric wires to the inter-connecting terminal.
Figure 17:
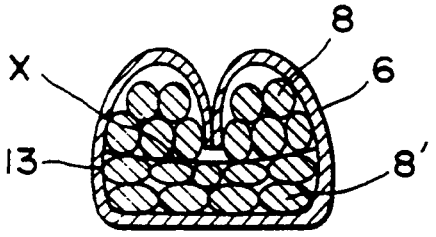
Fig. 17 Prior Art
FIG. 17 is a sectional view showing a problem of a conventional device.
Figure 15:
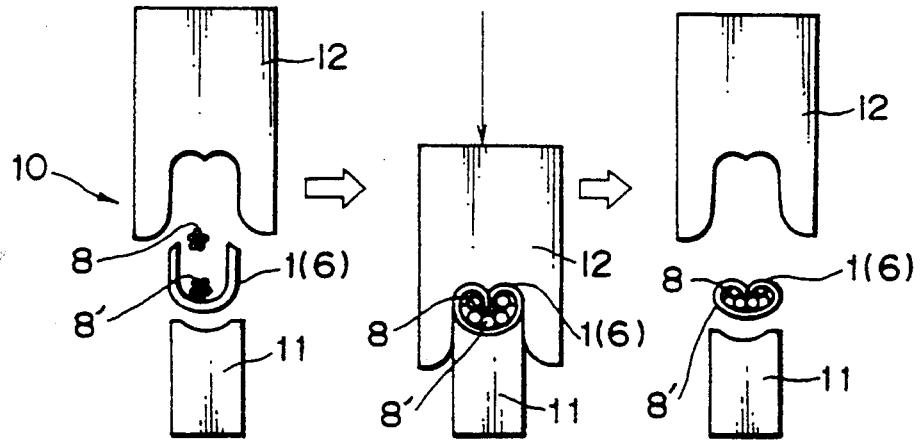
Fig. 15 Prior Art
FIG. 15 is a view showing the process of fixing electric wires to a terminal.
Figure 16:
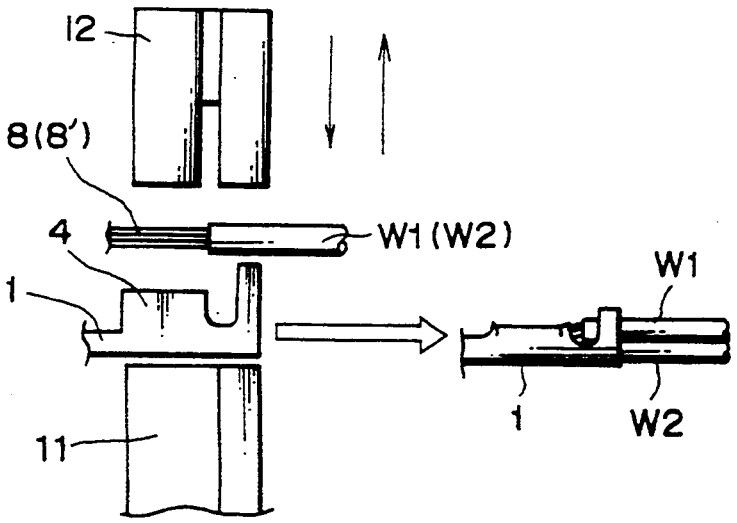
Fig. 16 Prior Art
FIG. 16 is a view showing the process of fixing the electric wires to the terminal.

The configurations and arrangement of the serrations 25, 26, 32 and 33 formed on the tab and those of the serrations 23*a* and 34 formed on the core wire-fixing barrel according to the first through fourth embodiment may be modified as shown in FIGS. 9A through 9F. That is, the serrations may be arranged at regular intervals horizontally as shown in FIG. 9A or diagonally as shown in FIG. 9B. The configuration thereof may be circular as shown in FIG. 9C; rectangular as shown in FIG. 9D; or cross-shaped as shown in FIG. 9F. In addition, the serrations may consist of narrow cuts and arranged at random as shown in FIG. 9E.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A terminal including a core wire-fixing barrel which is approximately U-shaped so as to have side walls and is crimped on two or more core wires inserted thereinto, said terminal comprising:

a tab having upper and lower surfaces with serrations formed thereon, said tab being disposed along a boundary between said core wires so that said serrations shear an oxide film formed on said core wires in contact with said upper and lower surfaces of said tab and remove said oxide film from said core wires, whereby said core wires are electrically connected with each other via said tab;

wherein said tab is integral with the core wire-fixing barrel; and wherein said tab consists of a pair of tabs projecting horizontally inwardly from and being one-piece with inner surfaces of both side walls of the core wire-fixing barrel so that the tabs are positioned in a middle portion of the core wire-fixing barrel in a vertical direction thereof.

2. A terminal constituting one of an inter-connecting terminal and an intermediate joint terminal including only one core wire-fixing barrel which is approximately U-shaped and is crimped on two or more core wires inserted thereinto, said terminal comprising:

a pair of tabs having upper and lower surfaces with serrations formed thereon, said tabs projecting horizontally and inwardly from and being one-piece with an inner surface of opposite side walls of the core wire-fixing barrel so as to make a slight gap between ends of said tabs, and some of the core wires being inserted between the tabs and a bottom wall of said terminal, and other core wires being inserted above the tabs, so that the serrations shear an oxide film formed on said core wires in contact with said upper and lower surfaces of a corresponding said tab and remove said oxide film from said core wires, whereby said core wires are electrically connected with each other via the corresponding said tab.

* * * * *